US006554683B2

(12) United States Patent
Hochfeld

(10) Patent No.: US 6,554,683 B2
(45) **Date of Patent: *Apr. 29, 2003**

(54) METHOD OF PLAYING AMUSEMENT GAME IN A TRAVELING VEHICLE

(75) Inventor: Alan Hochfeld, Holbrook, NY (US)

(73) Assignee: Leonard Holtz, New York, NY (US); part interest ( * ) Notice: Subject to any disclaimer, the term of this patent is extended or adjusted under 35 U.S.C. 154(b) by 0 days.

This patent is subject to a terminal disclaimer.

(21) Appl. No.: 09/844,539

(22) Filed: Apr. 27, 2001

(65) Prior Publication Data

US 2001/0016464 A1 Aug. 23, 2001

Related U.S. Application Data

(62) Division of application No. 09/185,113, filed on Nov. 3, 1998.

(51) Int. Cl.[7] ..... A63H 33/26

(52) U.S. Cl. ..... 446/485; 434/62; 434/69; 40/714

(58) Field of Search ..... 434/47, 62, 63, 434/66, 67, 69, 169, 176, 184; 446/485; 40/714, 715, 716, 737, 765

(56) References Cited

U.S. PATENT DOCUMENTS

| | | | | |
|---|---|---|---|---|
| 3,605,334 A | * | 9/1971 | Genin |
| 3,642,191 A | | 2/1972 | Roof |
| 3,899,177 A | | 8/1975 | Sells |
| 3,936,955 A | * | 2/1976 | Gruen |
| 4,116,449 A | | 9/1978 | Breslow |
| 4,343,474 A | * | 8/1982 | Caney |
| 4,968,258 A | | 11/1990 | Kees |
| 5,137,280 A | | 8/1992 | Love |
| 5,626,478 A | | 5/1997 | Gatlin |
| 5,741,561 A | | 4/1998 | Lenkin |

* cited by examiner

*Primary Examiner*—Jacob K. Ackun
*Assistant Examiner*—Bena B. Miller
(74) *Attorney, Agent, or Firm*—Frishauf, Holtz, Goodman & Chick, P.C.

(57) ABSTRACT

An amusement device for use in a traveling vehicle, includes a housing having a paper holding area defined by side walls and a bottom wall for receiving and holding a piece of paper therein, a transparent top wall in overlying relation to the paper holding area such that the piece of paper is viewable through the transparent wall, the transparent wall having an outer surface which can be written on and then erased, and a slot in one side wall for receiving the piece of paper into the paper holding area and for removing the piece of paper from the paper holding area; a mounting assembly for mounting the housing to a seat of the traveling vehicle so that the piece of paper is viewable by a person to the rear of the seat, the mounting assembly including two hook members connected with the housing for hanging the housing from the seat of the traveling vehicle; a plurality of light emitting diodes mounted in spaced relation to an inner surface of the transparent wall for providing an indication as to predefined points on the paper held in the paper holding area, the paper includes indicia thereon corresponding to the light emitting diodes; an actuation device for actuating selected ones of the light emitting diodes from a location remote from the housing; and a back light in the housing for illuminating a rear side of the piece of paper.

40 Claims, 5 Drawing Sheets

METHOD OF PLAYING AMUSEMENT GAME IN A TRAVELING VEHICLE

This application is a Division of application Ser. No. 09/185,113 filed on Nov. 3, 1998.

BACKGROUND OF THE INVENTION

The present invention relates generally to an amusement device for preventing boredom in a traveling vehicle, and more particularly, is directed to a children's traveling game or amusement device.

When riding in vehicles, particularly on long trips, children have a tendency to get bored very quickly. As a result, there is a tendency for the children to annoy and/or distract the driver and/or other passengers. For example, there is the common refrain by the children: "Are we there yet?".

Although children take various board games, video games, coloring books, reading books and the like along for the trip, these items often do not hold the child's interest and are thrown haphazardly about the vehicle. Further, with such items, the child is constantly looking down when playing or reading, which can result in nausea in a moving vehicle.

U.S. Pat. No. 3,899,177 to Sells discloses an automobile racing board game apparatus for play within a moving vehicle. In this game, the children look outside to find passing cars having the same color as his or her playing piece in a predetermined period of time, and then moves the playing piece by that number of spaces. However, this game has certain disadvantages. First, the game can only be played during the daytime when the colors of the passing cars are visible. Second, placement of the game in the vehicle can become cumbersome, particularly when there are three or more children in the vehicle. Further, this does not stem the children's constant curiosity as to the distance remaining during the trip.

U.S. Pat. No. 5,137,280 to Love discloses a geographic game which can be played in an automobile, even during darkness. A map, for example, of the United States is placed on the board, and each player has a piece of string which can be connected to different points on the map by pins. However, this game becomes cumbersome, since it must be placed on a seat or a person's lap to use. Further, the pins are small pieces that can become easily lost, and along with the string, makes the game impractical in use. Further, this does not stem the children's constant curiosity as to the distance remaining during the trip. U.S. Pat. No. 3,642,191 to Roof discloses an envelope of transparent sheets with a paper sheet removably positioned therebetween. A strap is secured to the assembly for carrying the assembly. Thus, a person can write on the transparent sheets in correspondence with markings on the paper sheet, and erase the same for re-use at a later time. However, there is no indication that this could be used in a moving vehicle, or that it could be used as an amusement device to prevent boredom by children.

Further, this does not stem the children's constant curiosity as to the distance remaining during the trip. U.S. Pat. No. 4,116,449 to Breslow discloses a game in which a playing surface has numerical indicia and an overlying clear sheet of acetate thereon and which can be lifted up to erase any markings made thereon. The players write on the acetate to connect dots corresponding to the numbers in order to create pictures. The object is to guess the picture that is being created before it is completed. This game, however, requires playing cards and a spinner. Also, as with the aforementioned games, playing of the game in a moving vehicle can be cumbersome. Further, this does not stem the children's constant curiosity as to the distance remaining during the trip.

U.S. Pat. No. 4,343,474 to Caney discloses a game device having a paper with an erasable pencil markable transparent flexible plastic sheet that can be written on and when depressed by the pencil, electrically bridges two contacts to cause an LED to energize. However, this game becomes cumbersome, since it must be placed on a seat or a person's lap to use. Also, it is very complicated in construction and use. Further, this does not stem the children's constant curiosity as to the distance remaining during the trip.

U.S. Pat. No. 5,741,561 to Lenkin merely discloses a placemat having an erasable surface and a pocket in which a paper can be placed with games, puzzles, etc. This is therefore similar to the aforementioned U.S. Pat. No. 3,642,191 to Roof, but without any strap. Further, this does not stem the children's constant curiosity as to the distance remaining during the trip.

U.S. Pat. No. 5,626,478 to Gatlin discloses a portable coaching device having a paper with an image of a playing field, and overlain by a transparent sheet that can be written upon by an erasable marker. The device includes straps with hooks that fit within holes of the board, in order to hang the device from a sheet of plexiglass. This device does not stem the children's constant curiosity as to the distance remaining during the trip.

U.S. Pat. No. 4,968,258 to Kees discloses a reusable learning aid which is similar to U.S. Pat. No. 5,741,561 to Lenkin, and suffers from the same deficiencies.

SUMMARY OF THE INVENTION

Accordingly, it is an object of the present invention to provide an amusement device for use in a traveling vehicle, that overcomes the aforementioned problems with the prior art.

It is another object of the present invention to provide an amusement device for use in a traveling vehicle that will prevent one or more children from getting bored.

It is still another object of the present invention to provide an amusement device for use in a traveling vehicle that can be played by only one child, or by a plurality of children.

It is yet another object of the present invention to provide an amusement device for use in a traveling vehicle that is not cumbersome to use.

It is a further object of the present invention to provide an amusement device for use in a traveling vehicle that can be used in the daylight and during darkness.

It is a still further object of the present invention to provide an amusement device for use in a traveling vehicle that can be hung from the back of the front seat for use by children in the rear seat.

It is a yet further object of the present invention to provide an amusement device for use in a traveling vehicle which always answers the children's constant curiosity as to the distance remaining during the trip.

In accordance with an aspect of the present invention, an amusement device for use in a traveling vehicle, includes a housing having a sheet holding area for receiving and holding a sheet, a transparent wall in overlying relation to the sheet holding area such that the sheet is viewable through the transparent wall, and a retaining section for receiving the sheet in the sheet holding area and for retaining the sheet from the sheet holding area; a mounting assembly for mounting the housing to a seat of the traveling vehicle so that the sheet is viewable by a person to the rear of the seat;

a plurality of lights mounted in spaced relation to the housing and providing an indication as to predefined points on the sheet held in the sheet holding area; and an actuation device for actuating selected ones of the lights from a location remote from the housing.

A back light is preferably provided in the housing for illuminating a rear side of the sheet. Further, the plurality of lights preferably include light emitting diodes mounted to an inner surface of the transparent wall or behind the transparent wall, with the sheet including indicia thereon corresponding to the light emitting diodes. A front light for illuminating the viewable surface of the sheet may also be provided.

In addition, the transparent wall preferably has an outer surface which can be written on and then erased.

The actuation device preferably includes a plurality of switches, each associated with a respective light for actuating the respective light.

Also, the mounting assembly includes suspension members for hanging the housing from the seat of the traveling vehicle.

The above and other objects, features and advantages of the present invention will become readily apparent from the following detailed description thereof which is to be read in connection with the accompanying drawings.

DETAILED DESCRIPTION

Figure 3:
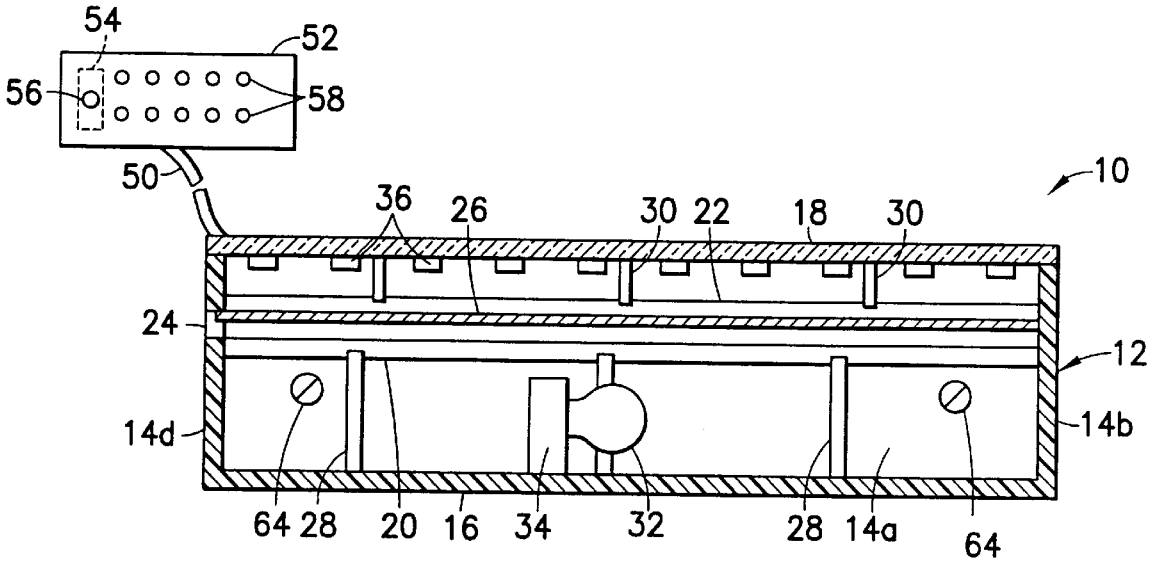
FIG. 3 is a cross-sectional view of the amusement device of FIG. 1, taken along line 3—3 thereof.

Referring to the drawings in detail, an amusement device 10 according to the present invention includes a housing 12 formed with four side walls 14*a*–14*d*, a bottom wall 16 and a transparent top wall 18, the latter top wall 18 being formed from a transparent plastic material that can be written upon with a marking device and then erased. As seen in FIG. 3, a first lower set of opposite ledges 20 are formed on the inner surfaces of side walls 14*a* and 14*c*, and a second lower set of opposite ledges 22 are formed on the inner surfaces of side walls 14*a* and 14*c* in spaced relation above ledges 20 so as to define a gap therebetween.

Figure 1:
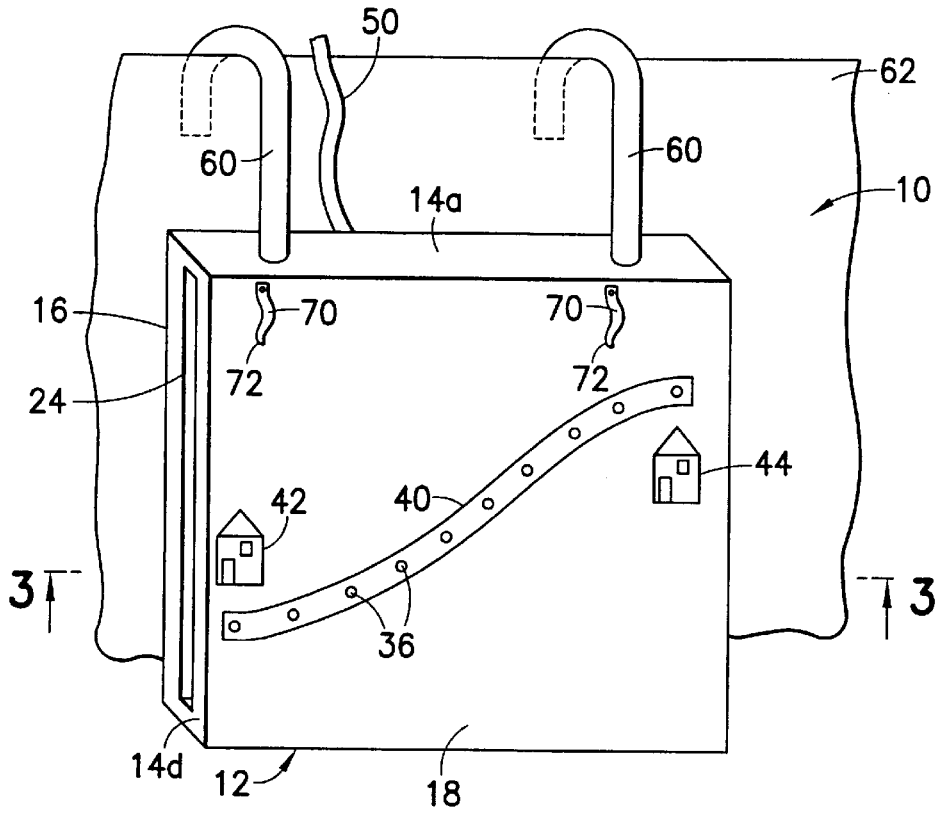
FIG. 1 is a perspective view of the amusement device according to the present invention.

A slot 24 is formed in side wall 14*d* between ledges 20 and 22, for insertion of a piece of paper 26 or the like therein and removal of the paper 26 therefrom, which paper is retained in the slot 24 between ledges 20 and 22. In addition, posts 28 extend from the inner surface of bottom wall 16 and posts 30 extend from the inner surface of top wall 18 to prevent sagging of paper 26 between ledges 20 and 22. Since the top wall 18 is transparent, any writing on paper 26 will show through the top wall 18, as seen in FIG. 1.

A lightbulb 32 is receivable in a socket 34 mounted to the inner surface of bottom wall 16 for providing a back light to any picture on paper 26. The light bulb may be incandescent (as shown), fluorescent to provide more even light distribution, or any other type of light source.

A plurality of lights, such as light emitting diodes (LEDs) 36 are mounted to or behind the inner surface of top wall 18 in a predetermined pattern, for example, along a line 40 (see FIG. 1) drawn on paper 26 to designate a route to be traveled. In this instance, as shown in FIG. 1, a marker, such as a house 42 can be drawn at one end of line 40 to correspond to a start point, and another marker, such as another house 44 can be drawn at the other end of line 40 to correspond to an end or destination point.

Figure 4:
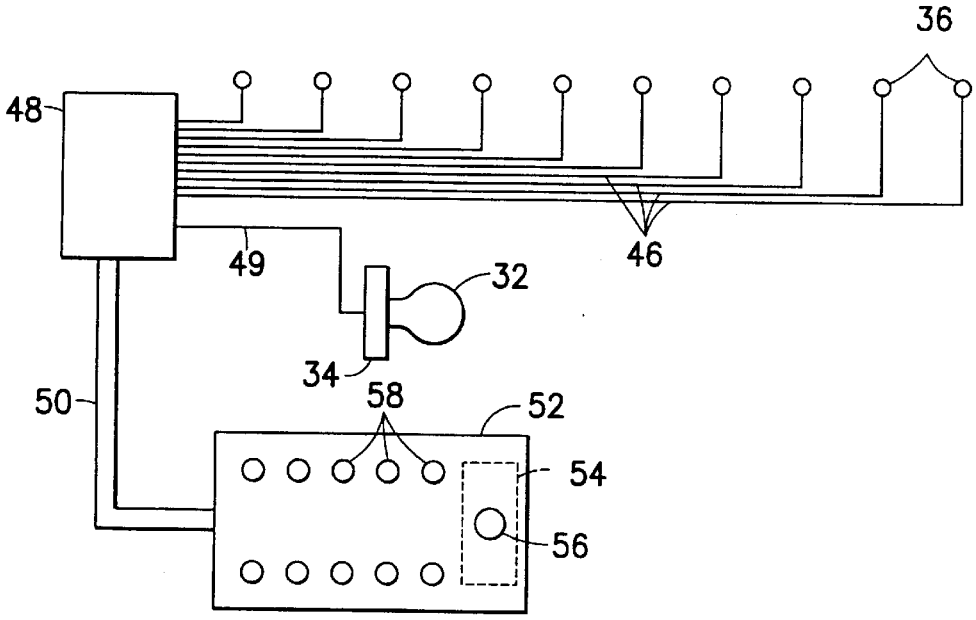
FIG. 4 is a schematic circuit diagram of the electronic components.

As seen in FIG. 4, LEDs 36 are each connected by wires 46 to an electrical box 48 in housing 12. A wire 49 that is connected to socket 34 of light 32 also extends out of the electrical connection box 48. Wires 46 and 49 preferably exit electrical box 48 through a bundled cable 50, the opposite end of which is connected to a remote control button box 52 having a battery 54 therein. A power switch or button 56 is provided on button box 52 for turning the amusement device ON and OFF, that is, for electrically connecting and disconnecting the same from battery 54. As is well known, the battery can be replaced by a power source which, for example, plugs into a cigar lighter of the vehicle.

Button box 52 further includes a plurality of switches or buttons 58 corresponding in number to the number of LEDs 36, with each button 58 corresponding to one LED 36. Button box 52 may also have a jack (now shown) to connect to a cigarette lighter socket of the vehicle to receive power from the vehicle instead of from batteries.

Figure 2:
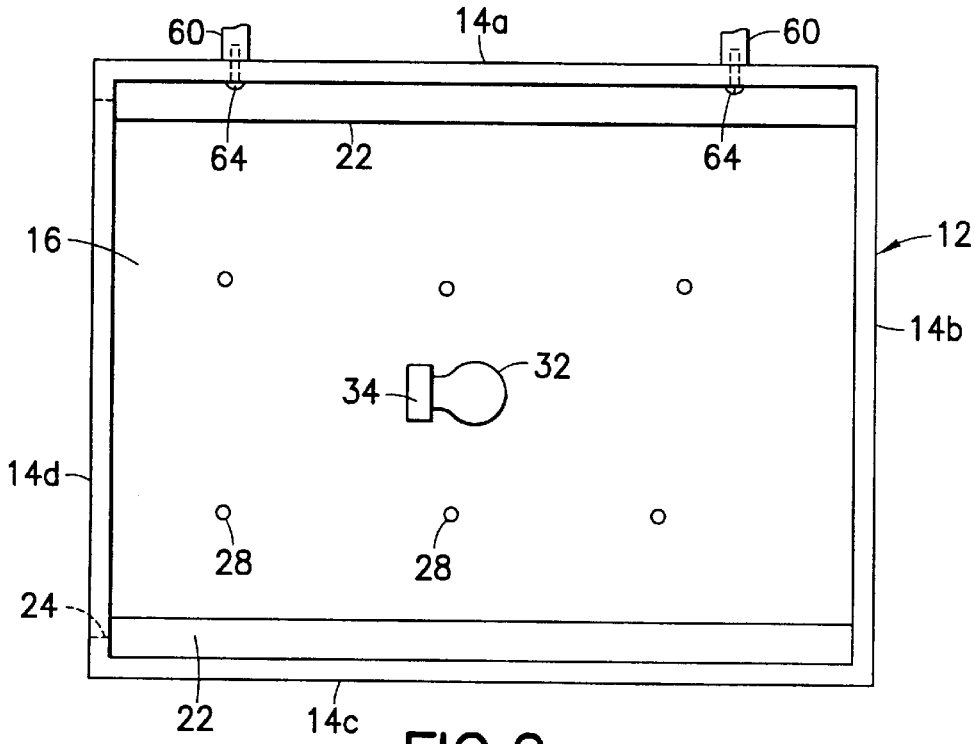
FIG. 2 is a top plan view of the amusement device with the front panel and picture removed.

As also shown in FIGS. 1 and 2, two hooks or suspension devices 60 are connected to side wall 14*a* by bolts 64, so that amusement device 10 can be hung from the back of the front seat 62 of a vehicle, as shown in FIG. 1.

With the arrangement described above, amusement device 10 can be hung from the back of the front seat 62 of a vehicle so that it is viewable by children in the rear seat of the vehicle. A piece of paper 26 having, for example, the aforementioned indicia 40, 42 and 44 is inserted through slot 24 so that the indicia are viewable through transparent top wall 18. As the trip progresses, an adult in front (or back) seat 62, who has control of button box 52, can press buttons 58 in a particular sequence to light LEDs 36 in order to show the progression of the trip. In this regard, the adult can have a similar paper 26 with markings corresponding to streets or other identifications, in order to determine which buttons to push and when to push the buttons. As a result, a child in the rear seat will know how far the trip has progressed, without constantly asking.

Further, because top wall 18 is transparent and erasable, the children can write upon top wall 18 in order to further enhance the picture on paper 26. For example, trees and landmarks can be drawn on top wall 18, and can later be erased, thereby occupying the children's time to prevent boredom.

In addition, during progress of the trip, the paper or other sheet 26 can be removed and can be drawn upon by the children in the vehicle. After changes or additions have been made to the paper 26, it can be re-inserted into the housing 12 and can be observed by the children. This enhances the amusement value and usefulness of the device of the present invention.

While the housing 12 is shown as a single unit with a slot for entry and removal of paper or the like 26 therein, the housing can have a hinged flip-up outer or front surface, behind which the paper 26 or the like is placed. The precise arrangement of the paper relative to the front surface of the housing 12 can be varied, as desired.

Figure 5:
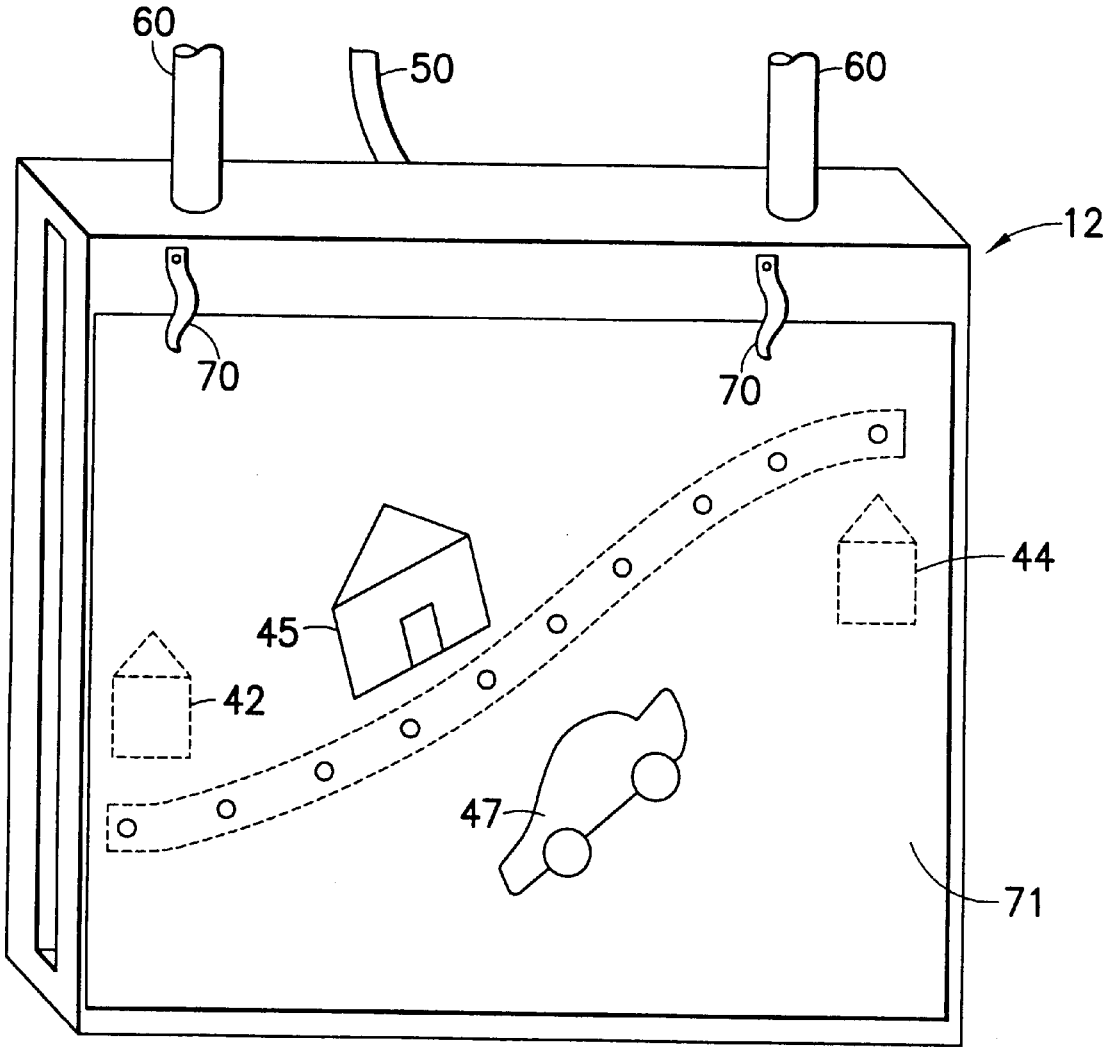
FIG. 5 shows a modified embodiment.

Still further, a transparent or translucent sheet 26 can be placed over the outer surface of the housing 12 and can be retained, for example, by spring clips 70 (see FIG. 1) which can be made of, for example, spring metal, which are riveted rivets 71 to the housing 12. In use, a sheet would be placed under the free ends 72 of the spring clips 70 and thereby be retained in place over the outer surface of the housing 12. When the light 32 is lit, this would illuminate the transparent or translucent outer sheet, and further enhance the operability. FIG. 5 shows a modified embodiment with a further sheet 71 (transparent or translucent) clipped under the spring clips 70. Such a further sheet 71 shown in FIG. 5 can be used with or without the sheet 26 inserted in slot 24. The transparent or translucent sheet clipped under spring clip 70 as shown in FIG. 5 can also be made of a material which is erasable so that it can be re-used for subsequent trips. For example, the sheet 71 can be made of a plastic material which is erasable and/or the markings on sheet 71 can be made of a water-soluble and washable ink.

In addition, by hanging amusement device 10 from front seat 62 by means of hooks 60, there is no problem with space, and the amusement device 10 is not cumbersome to use.

It will be appreciated that the present invention can be used without actuating the LEDs 36 so that a scenic or other picture on paper 26 can be inserted into slot 24, and the children can merely write upon erasable top wall 18 to enhance the picture. Alternatively, LEDs 36 can be used without writing on top wall 18.

Figure 6:
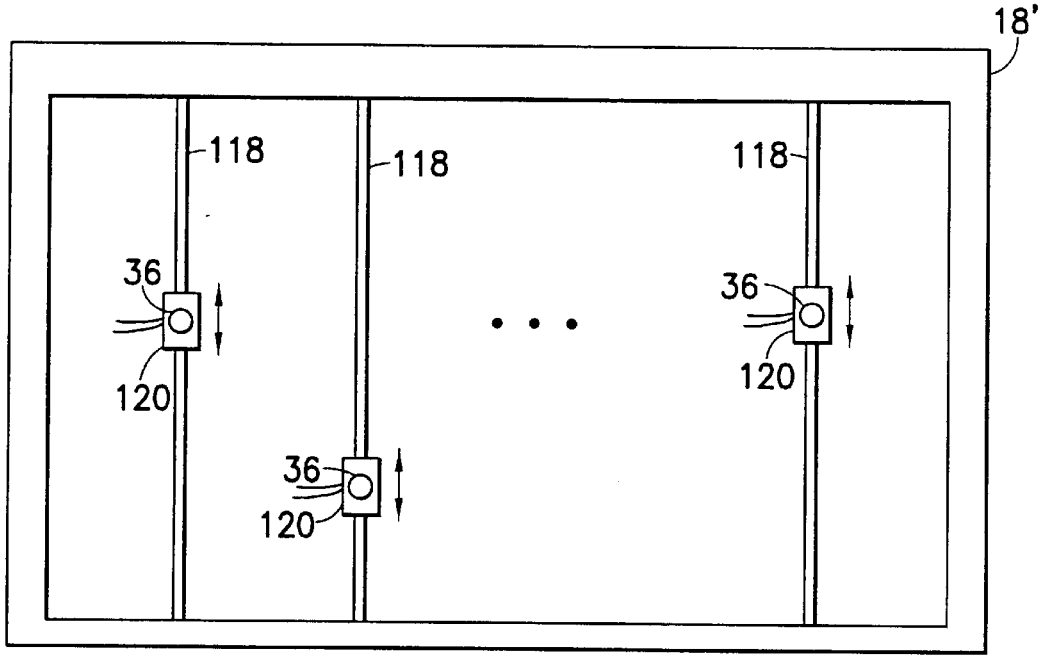
FIG. 6 shows a further modified embodiment with adjustable track-like lights.

FIG. 6 shows a modified arrangement wherein the rear member 18 of the embodiment of FIG. 3 is replaced by a frame-like structure 18' having rods or other elongated members 118 secured thereto. Blocks 120 which are slidable along the respective rods or elongated members 118 are provided with LED's 36 mounted thereon, which LED's are wired, for example, as shown in FIG. 4. The blocks 120 are mounted on the rods 118 with a frictional fit so that when the block 120 are slid to the desired positions, they remain at the desired positions. Locking devices such as screws or other locking members could be provided to lock the positions of sliding blocks 120 relative to the respective elongated members 118. Using the embodiment of FIG. 6 the position of the lights represented by LED's 36 can be varied to accommodate a particular scene or other pictorial item mounted to the front of the game, go that the appropriate portions of the scene can be lit, as desired.

It is also pointed out that the configuration of the present invention can be made reversible so that a two-sided capability is provided, for example for a "second day" of a vacation experience. This can be easily accomplished by providing the rear surface of the device shown in FIGS. 1 and 2 with a set of clips 70 on the rear surface to accommodate a picture or other sheet, which could then be used on a second day of a vacation experience. When the adjustable lights of FIG. 6 are used, the dual illustration capability is further improved, since the lights can be easily adjusted to accommodate the second day pictorial information.

Figure 7:
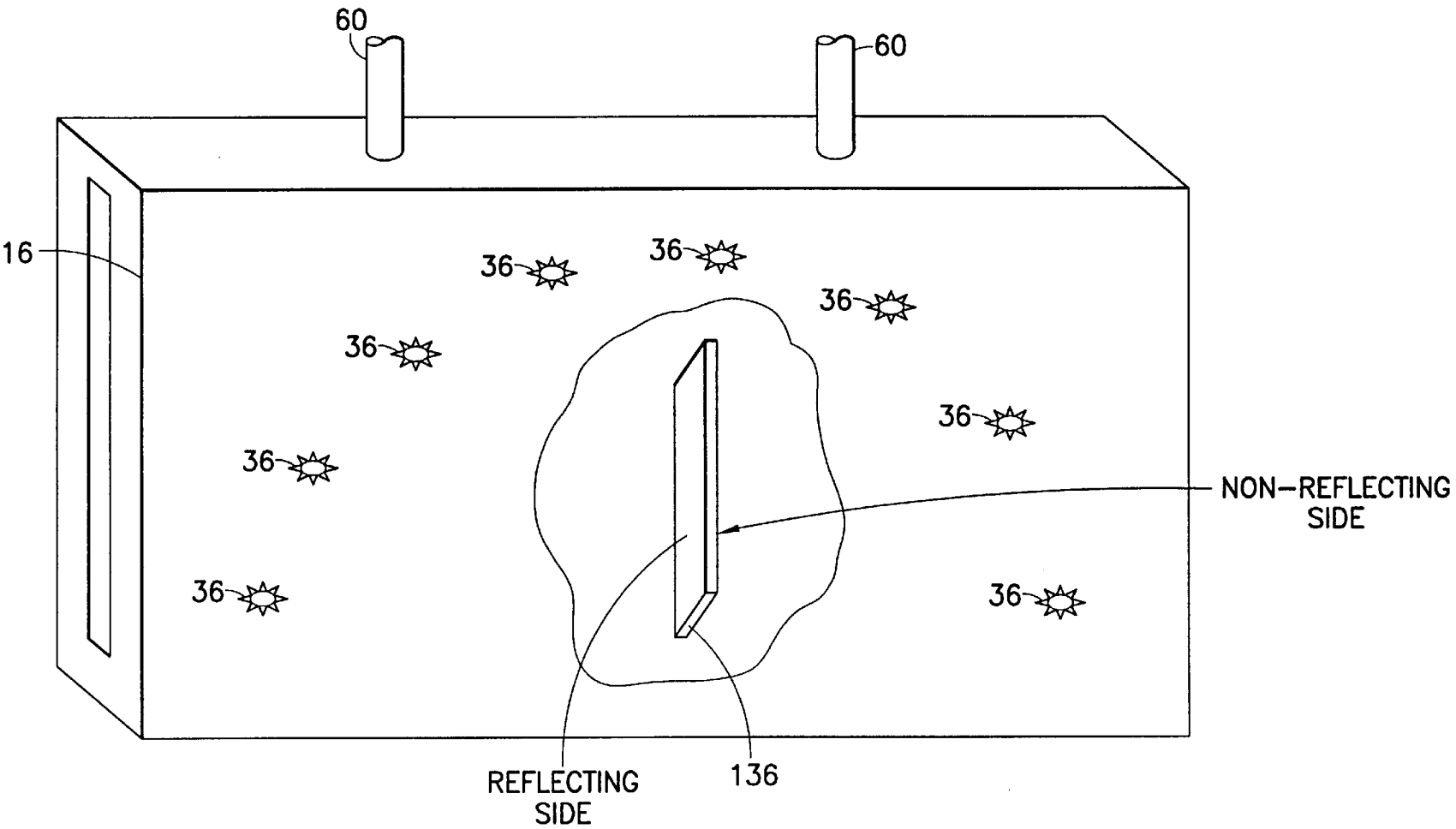
FIG. 7 shows a still further modified embodiment which simulates advancing of light from one time of day to another.

FIG. 7 shows a still further modified embodiment including a mirror mounted in the internal portion thereof, for example near light 32 of FIG. 2, so that one side of the mirror reflects light, and the other side of the mirror does not reflect light. In this manner, as the lights advance from left-to-right in FIG. 7, the movement appears to be from sunrise to sunset, thereby further enhancing the interest provided by the present invention. In FIG. 7, a portion of the front of the device is shown broken away so that the internally provided mirror can be seen.

Figure 8:
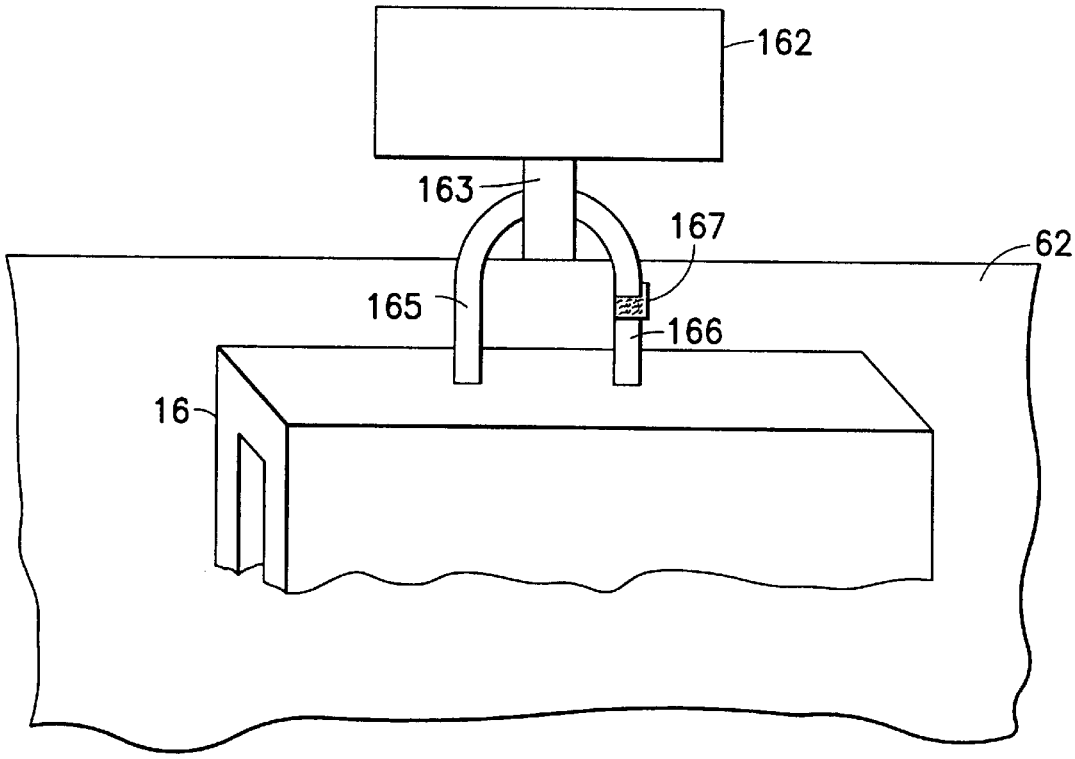
FIG. 8 shows another suspension device for attachment to a seat of a vehicle.

FIG. 8 shows another mounting arrangement wherein the vehicle seat 62 has a head-rest 162 secured thereto by means of a vertical member 163. The mounting structure for the amusement device of the present invention is shown in this arrangement as being strap-like members 165, 166 which extend upwardly from the upper portion of the amusement device 16 and which are connectable around the vertical post 163 of the head-rest 162. The straps 165, 166 can be held together by mating hook-and-loop connectors (as shown) or can be connected by snaps, buckles or any other connections technique to suspend the housing 16 of the amusement device. Only one side of the hook-and-loop connector (for example, loops 167) is shown in FIG. 8.

It will be appreciated that various modifications can be made with the present invention. For example, in place of bundled cable 50, button box 52 can include a transmitter which transmits an RF signal to a receiver in housing 12 for actuating LEDs 36.

Having described a specific preferred embodiment of the invention with reference to the accompanying drawings, it will be appreciated that the present invention is not limited to that precise embodiment, and that various changes and modifications can be effected therein by one of ordinary skill in the art without departing from the scope or spirit of the invention as defined by the appended claims.

What is claimed is:

1. A method of playing an amusement game in a traveling vehicle, comprising;

providing a sheet having travel indicia thereon which represents a travel route of the vehicle;

providing a housing including:

a sheet holding area for receiving and holding the sheet, a transparent wall in overlying relation to said sheet holding area such that the sheet is viewable through the transparent wall, and a retaining section for receiving the sheet in the sheet holding area and for retaining the sheet in the sheet holding area;

mounting the housing to a portion of the traveling vehicle so that the sheet is viewable by a person in the rear of the vehicle;

providing a plurality of lights mounted in spaced relation to the housing in the vicinity of the sheet held in the sheet holding area, said lights being arranged to illuminate respective portions of the sheet including respective portions of the travel indicia on the sheet, thereby providing a luminous indication on the sheet as to predefined points along the travel route represented by the travel indicia on the sheet; and actuating selected ones of said lights from a location remote from said housing so as to illuminate selected points along the travel route represented on the sheet, thereby visually indicating by illuminated lights the travel progress of the vehicle along the travel route.

2. The method according to claim 1, comprising inserting said sheet into said sheet holding area which is defined by side walls, and a bottom wall connected with lower ends of said side walls, with said transparent wall forming a top wall connected with upper ends of said side walls so as to define said sheet holding area.

3. The method according to claim 2, comprising inserting said sheet into an opening which is provided as a slot in a first one of said side walls.

4. The method according to claim 3, wherein said housing further includes a first set of members on opposite second and third ones of said side walls, and a second set of members on inner surfaces of said second and third ones of said side walls in spaced relation to the first set of members so as to define a gap between members of the first set and corresponding members of the second set, with the gap being aligned with said opening in said one side wall, and further comprising restraining the sheet inserted in the sheet holding area by said members engaging the inserted sheet.

5. The method according to claim 1 further comprising illuminating a rear side of the sheet held in the sheet holding area.

6. The method according to claim 1, wherein said step of providing said plurality of lights includes providing a plurality of light emitting diodes.

7. The method according to claim 6, comprising mounting said light emitting diodes to an inner surface of said transparent wall.

8. The method according to claim 1, comprising providing said transparent wall with an outer surface which can be written on and then erased, and comprising writing indicia on said outer surface of said transparent wall.

9. The method according to claim 1, wherein said actuating step includes actuating at least one of a plurality of switches, each of said switches being associated with a respective light for actuating the respective light.

10. The method according to claim 1, wherein said mounting step includes engaging two hook members connected with said housing to a seat of the traveling vehicle.

11. A method of playing an amusement game in a traveling vehicle, comprising:

providing a sheet having travel indicia thereon which represents a travel route of the vehicles;

providing a housing including:

a sheet holding area for receiving and holding the sheet, a transparent wall in overlying relation to said sheet holding area such that the sheet is viewable through the transparent wall, said transparent wall having an outer surface which can be written on and then erased, and a section for receiving the sheet in the sheet holding area and for retaining the sheet in the sheet holding area;

mounting the housing to a portion of the traveling vehicle so that the sheet is viewable by a person in the rear of the vehicle, by a mounting assembly including members connected with said housing for coupling said housing to said portion of the traveling vehicle;

providing a plurality of lights mounted in spaced relation to an inner surface of the transparent wall in the vicinity of the sheet held in the sheet holding area, said lights being arranged to illuminate respective portions of the sheet including respective portions of the travel indicia on the sheet, thereby providing a luminous indication on the sheet as to predefined points along the travel route represented by the travel indicia on the sheet; and actuating selected ones of said lights from a location remote from said housing so as to illuminate selected points along the travel route represented on the sheet, thereby visually indicating by illuminated lights the travel progress of the vehicle along the travel route.

12. The method according to claim 11, comprising inserting said sheet into said sheet holding area which is defined by side walls and a bottom wall connected with lower ends of said side walls, with said transparent wall forming a top wall connected with upper ends of said side walls so as to define said sheet holding area.

13. The method according to claim 12, comprising inserting said sheet into an opening which is provided as a slot in a first one of said side walls.

14. The method according to claim 13, wherein said housing further includes a first set of members on opposite second and third ones of said side walls, and a second set of members on inner surfaces of said second and third ones of said side walls in spaced relation to the first set of members so as to define a gap between members of the first set and corresponding members of the second set, with the gap being aligned with said opening in said one side wall, and further comprising restraining the sheet inserted in the sheet holding area by said members engaging the inserted sheet.

15. The method according to claim 11, further comprising illuminating a rear side of the sheet held in the sheet holding area.

16. The method according to claim 11, wherein said step of providing said plurality of lights includes providing a plurality of light emitting diodes.

17. The method according to claim 11, wherein said actuating step includes actuating at least one of a plurality of switches, each of said switches being associated with a respective light for actuating the respective light.

18. A method of playing an amusement game in a traveling vehicle, comprising:

providing a sheet having travel indicia thereon which represents a travel route of the vehicle;

providing a housing including a sheet holding area for receiving and holding the sheet;

arranging the housing in a portion of the traveling vehicle so that the sheet is viewable by a person in the rear of the vehicle;

providing a plurality of lights mounted in spaced relation to the housing in the vicinity of the sheet held in the sheet holding area, said lights being arranged to illuminate respective portions of the sheet including respective portions of the travel indicia on the sheet, thereby providing a luminous indication on the sheet as to predefined points along the travel route represented by the travel indicia on the sheet; and actuating selected ones of said lights so as to illuminate selected points along the travel route represented on the sheet, thereby visually indicating by illuminated lights the travel progress of the vehicle along the travel route.

19. The method according to claim 18, further comprising illuminating a rear side of the sheet held in the sheet holding area.

20. The method according to claim 18, wherein said actuating step comprises actuating selected ones of said lights from a location remote from said housing.

21. The method according to claim 18, further comprising viewing said sheet through a transparent wall which is provided in overlying relation to said sheet holding area such that the sheet is viewable through the transparent wall.

22. The method according to claim 21, comprising providing said transparent wall with an outer surface which can be written on and then erased, and comprising writing indicia on said outer surface of said transparent wall.

23. The method according to claim 18, wherein said actuating step includes actuating at least one of a plurality of switches, each of said switches being associated with a respective light for actuating the respective light.

24. A method of playing an amusement game in a traveling vehicle, comprising:

providing a sheet having travel indicia thereon which represents a travel route of the vehicle;

providing a housing including:

a sheet holding area for receiving and holding the sheet, and a transparent wall in overlying relation to said sheet holding area such that the sheet is viewable through the transparent wall, said transparent wall having an outer surface which can be written on and then erased, and arranging the housing in the traveling vehicle so that the sheet is viewable by a person in the rear of the vehicle, by coupling said housing to a portion of the traveling vehicle;

providing a plurality of lights mounted in spaced relation to an inner surface of the transparent wall in the vicinity of the sheet held in the sheet holding area, said lights being arranged to illuminate respective portions of the travel indicia on the sheet, thereby providing a luminous indication on the sheet as to predefined points along the travel route represented by the travel indicia on the sheet; and actuating selected ones of said lights so as to illuminate selected points along the travel route represented on the sheet, thereby visually indicating by illuminated lights the travel progress of the vehicle along the travel route.

25. The method according to claim 24, further comprising illuminating a rear side of the sheet held in the sheet holding area.

26. The method according to claim 24, wherein said actuating step comprises actuating selected ones of said lights from a location remote from said housing.

27. The method according to claim 24, wherein said actuating step includes actuating at least one of a plurality of switches, each of said switches being associated with a respective light for actuating the respective light.

28. A method of playing an amusement game in a traveling vehicle, comprising:

providing a sheet having travel indicia thereon which represents a travel route of the vehicle;

providing a housing including:

a sheet holding area for receiving and holding the sheet, and a retaining section for receiving the sheet in the sheet holding area and for retaining the sheet in the sheet holding area;

arranging the housing in a portion of the traveling vehicle so that the sheet is viewable by a person in the vehicle;

providing a plurality of lights mounted in spaced relation to the housing in the vicinity of the sheet held in the sheet holding area, said lights being arranged to illuminate respective portions of the sheet including respective portions of the travel indicia on the sheet, thereby providing a luminous indication on the sheet as to predefined points along the travel route represented by the travel indicia on the sheet; and actuating selected ones of said lights so as to illuminate selected points along the travel route represented on the sheet, thereby visually indicating by illuminated lights the travel progress of the vehicle along the travel route.

29. The method according to claim 28, comprising inserting said sheet into said sheet holding area which is defined by said walls and a bottom wall connected with lower ends of said side walls, and a transparent wall forming a top wall connected with upper ends of said side walls so as to define said sheet holding area, and arranging said transparent wall so as to be in overlying relation to a sheet received in said sheet holding area.

30. The method according to claim 29, comprising inserting said sheet into an opening which is provided as a slot in a first one of said side wall.

31. The method according to claim claim 28, comprising providing said transparent wall with an outer surface which can be written one and then erased, and comprising writing indicia on said outer surface of said transparent wall.

32. The method according to claim 28, further comprising illuminating a rear side of the sheet held in the sheet holding area.

33. The method according to claim 28, wherein said step of providing said plurality of lights includes providing a plurality of light enitting diodes.

34. The method according to claim 28, wherein said actuating step includes at least one of a plurality of switches, each of said switches being associated with a respective light for actuating the respective light.

35. A method of playing an amusement game in a traveling vehicle, comprising:

providing a sheet having travel indicia thereon which represents a travels route of the vehicle;

providing a housing including:

a sheet holding area for receiving and holding the sheet, and a section for receiving the sheet in the sheet holding area and for retaining the sheet in the sheet holding area;

mounting the housing to a portion of the traveling vehicle so that the sheet is viewable by a person in a vehicle, by a mounting assembly including members connected with said housing for coupling said housing to said portion of the traveling vehicle;

providing a plurality of lights mounted in spaced relation to an inner surface of a transparent wall arranged in the vicinity of the sheet held in the sheet holding area, said lights being arranged to illuminate respective portions of the sheet including respective portions of the travel indicia on the sheet, thereby providing a luminous indication on the sheet as to predefined points along the travel route represented by the travel indicia on the sheet; and actuating selected ones of said lights so as to illuminate selected points along the travel route represented on the sheet, thereby visually indicating by illuminated lights the travel progress of the vehile along the travel route.

36. The method according to claim 35, comprising providing said housing with side walls and a bottom wall connected with lower ends of said side walls, and with a transparent wall forming a top wall connected with upper ends of said side walls so as to define said sheet holding area, and arranging said transparent wall in overlying relation to a sheet received in said sheet holding area such that the sheet is viewable through said transparent wall.

37. The method according to claim 36, comprising providing an opening which is provided as a slot in a first one of said side walls.

38. The method according to claim 35, wherein said step of providing said plurality of lights includes providing a plurality of light emitting diodes.

39. The method according to claim 35, wherein said step of providing said plurality of lights includes providing a plurality of light emitting diodes.

40. The method according to claim 35, wherein said actuating step includes actuating at least one of a plurality of switches, each of said switches being associated with a respective light for actuating the respective light.

* * * * *